US006202539B1

(12) United States Patent
Feygin

(10) Patent No.: US 6,202,539 B1
(45) Date of Patent: Mar. 20, 2001

(54) ARTICLE COMPRISING A Z-AXIS POSITIONING STAGE

(75) Inventor: Ilya Feygin, Mountainside, NJ (US)

(73) Assignee: Pharmacopeia, Inc., Princeton, NJ (US)

( * ) Notice: Subject to any disclaimer, the term of this patent is extended or adjusted under 35 U.S.C. 154(b) by 0 days.

(21) Appl. No.: 09/273,145

(22) Filed: Mar. 19, 1999

(51) Int. Cl.[7] ..... F01B 29/00
(52) U.S. Cl. ..... 92/161
(58) Field of Search ..... 92/34, 40, 90, 92/37, 92, 136, 137, 161; 91/361, 363 R; 248/404

(56) References Cited

U.S. PATENT DOCUMENTS 2,576,908 * 11/1951 Wallace ..... 92/161
2,668,517 * 2/1954 Craft ..... 92/161
3,420,147 * 1/1969 Beach ..... 92/37
3,469,502 * 9/1969 Gardner ..... 92/34
5,181,452 * 1/1993 Immega ..... 92/34
5,317,952 * 6/1994 Immega ..... 92/34
5,697,285 * 12/1997 Nappi et al. ..... 92/92
5,702,083 * 12/1997 Lai ..... 248/404

* cited by examiner

*Primary Examiner*—Edward K. Look
(74) *Attorney, Agent, or Firm*—DeMont & Bayer, LLC; Wayne S. Breyer; Jason Paul DeMont

(57) ABSTRACT

An article comprising a Z-axis positioning stage is disclosed. The Z-axis positioning stage includes at least one collapsible/expandable cell or cavity that is defined within a region bounded by a lower and a movable upper surface and a side wall depending therefrom. Means for collapsing/expanding the cavity is operatively connected to the cavity. During collapse of the cavity, the upper surface drops towards the lower surface. During expansion of the cavity, the upper surface rises away from lower surface. The upper surface thus functions as a movable stage, which is capable of moving an object placed thereon in a vertical direction (i.e., along the z-axis).

16 Claims, 3 Drawing Sheets

ARTICLE COMPRISING A Z-AXIS POSITIONING STAGE

FIELD OF THE INVENTION

The present invention relates to a positioning stage. More particularly, the present invention relates to stage that is positionable along the z-axis.

BACKGROUND OF THE INVENTION

The need for precision positioning arises in a wide variety of arts, and many different devices have been devised to satisfy that need. Such devices are generically referred to as positioning stages.

Positioning stages are typically operable to move along one or two or three or more axes. Horizontal one- or two-axes positioning stages are relatively easy to implement, although the art is replete with relatively complicated implementations of such X-Y stages that include elements such as position sensors and linear motors as drive devices.

Vertical (Z-axis) positioning stages are more difficult to implement than horizontal (X-Y) positioning stages. Unlike X-, Y- or XY-stages, a Z-axis positioning stage is not supported in the horizontal plane and therefore requires stabilization in that plane, as well as along the Z-axis. Typically, rails, guide pins, scissors systems or the like are required to maintain the X-Y position of a vertical positioning stage. Moreover, for Z-axis positioning, the weight of the stage and frictional forces associated with the stage's movement must be overcome.

Z-axis positioning stages become especially complicated when rapid stage movement is required. The art has addressed such complications with electrically-driven systems incorporating ball screws, belts and the like, as well as with pneumatically-driven systems. Electrically-driven systems are very complex and require numerous components, and pneumatically-driven systems tend to be very bulky. Both electrical and pneumatic systems typically require special structural frames and supports. Due to their complexity, such systems are relatively expensive and may suffer from reliability problems.

The art would therefore benefit from a simple z-axis positioning stage capable of rapid, precise positioning. Such a stage would be more reliable and less expensive than conventional z-axis positioning stages.

SUMMARY OF THE INVENTION

In one embodiment, a Z-axis positioning stage in accordance with the present teachings includes at least one collapsible/expandable cell or cavity that is defined between a lower and an upper surface and a side wall depending therefrom. A device that is operable to collapse/expand the cavity is operatively connected to the cavity.

During collapse of the cavity, the upper surface drops towards the lower surface. During expansion of the cavity, the upper surface rises away from lower surface. The upper surface thus functions as a movable stage, which is capable of moving an object placed thereon in a vertical direction (i.e., along the z-axis).

In some embodiments, cavity collapse/expansion is effected by changing pressure within the cavity. This can be accomplished via vacuum-generating equipment or pressurizing equipment. In additional embodiments, feedback control is advantageously incorporated in the Z-axis positioning stage. An illustrative feedback system includes a displacement sensor, a controller, and a final control element.

In further embodiments, the present invention comprises a two-, three- or more axes positioning stage. In such embodiments, the present Z-axis positioning stage is advantageously used in conjunction with horizontal (X-, Y- or XY) positioning stages.

Conventional Z-axis positioning stages typically use rigid drive systems. If a dispensing member (e.g., a syringe) malfunctions and forceably contacts a receiver vessel disposed on such a rigidly-driven stage, the dispensing member is likely to be damaged. The present Z-axis stage advantageously possesses a "pliability" or "springiness" by virtue of its "cavity drive" that reduces the likelihood of damage under the aforementioned scenario.

DETAILED DESCRIPTION

Figure 1:
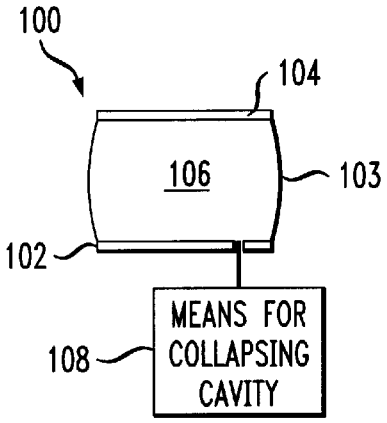
FIG. 1 is a simplified conceptual depiction of a z-axis positioning stage in accordance with an illustrative embodiment of the present invention.

FIG. 1 depicts, via a simplified, conceptual illustration, z-axis positioning stage 100 in accordance with the present teachings. Z-axis positioning stage 100 includes a lower surface 102, a side wall 103 and an upper surface 104. A collapsible/expandable cell or cavity 106 is defined between the lower and upper surfaces 102 and 104 and side wall 103. Although a single cell or cavity 106 is depicted in FIG. 1, in other embodiments, the region within the upper and lower surfaces and side wall comprises a plurality of cells or cavities. A system or device 108 for collapsing or expanding cavity 106 is operatively connected to the cavity.

In some embodiments, device 108 collapses/expands cavity 106 by changing the pressure therein. Examples of device 108 suitable for changing pressure within cavity 106 include vacuum-generating equipment, such as mechanical vacuum pumps or jet ejectors, as well as pressurizing equipment, such as a compressor. Such equipment is well known and readily selected/specified as a function of application specifics by those of ordinary skill in the art.

When cavity 106 is at least partially expanded, decreasing pressure within the cavity causes at least a partial collapse thereof. Alternatively, when cavity 106 is at least partially collapsed, increasing the pressure within the cavity causes at least a partial expansion thereof. During collapse of cavity 106, upper surface 104 drops towards lower surface 102. During expansion of cavity 106, upper surface 104 rises away from lower surface 102. Upper surface 104 thus becomes a movable stage, which is capable of moving an object placed thereon in a vertical direction (i.e., along the z-axis).

It will be appreciated that side wall 103 must not be allowed to collapse "inwardly" in the manner of an hourglass as pressure is reduced in cavity 106. A greater likelihood for such inwardly-directed collapse exists as the height of side wall 103 increases relative to the size of upper surface 104. As a guideline, the diameter of upper surface 104 should be greater than the height of side wall 103. It will be appreciated, however, that the material comprising sidewall 103 is a key determinant of any height limitation. Such a limitation is therefore best determined by simple experimentation once materials are selected.

FIGS. 2–5*a*/5*b* depict several illustrative implementations of conceptual Z-axis positioning stage 100 depicted in FIG. 1.

Figure 2:
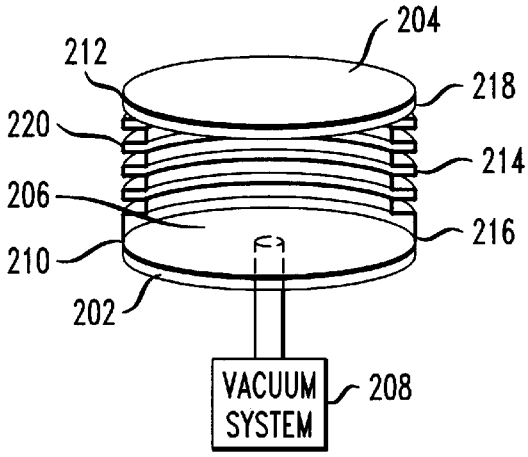
FIG. 2 depicts an illustrative embodiment of a single cavity z-axis positioning stage in accordance with the present teachings.

FIG. 2 depicts Z-axis positioning stage 200, which includes base 202 having perimeter 210, receiving platform 204 having perimeter 212 and skirt 214. In FIG. 2, the front portion of skirt 214 is "cutaway" for clarity of illustration. A lower edge 216 of skirt 214 is attached to base 202 at its perimeter 210, and an upper edge 218 of skirt 214 is attached to receiving platform 204 at its perimeter 212. Cavity 206 is defined within the space bounded by base 202, receiving platform 204 and skirt 214.

Receiving platform 204 is movable along the Z-axis upon collapse or expansion of cavity 206. When z-axis "translation" is desired, the skirt must remain sufficiently rigid along the X -and Y-axes to prevent deflection in the X-Y plane. In the embodiment illustrated in FIG. 2, such rigidity is achieved by forming skirt 214 from a rigid material such as metal or metal alloys, and by providing an "accordion pleat" or "corrugation" 220 therein. Pleat or corrugation 220 allows skirt 214 to freely expand or collapse (along the Z-axis) in the manner of a bellows, while the rigid metal/alloy construction substantially prevents any deflection in the X-Y plane. Such a metal "bellows" is commercially available from Servometer, Inc. of Cedar Grove, N.J. In embodiments wherein some deflection in the X-Y plane is acceptable, less rigid materials (e.g., rubber) can be used to form skirt 214.

The use of metal or metal alloys and corrugations, as described above, is effective in preventing the afore-described inwardly-directly collapse of the present stage. If a non-corrugated, flexible material (e.g., rubber) is used as skirt 214, then the skirt should be curved outwardly (i.e., like an inflated bicycle tire tube) when in a fully-uncompressed state. Such curvature should prevent the skirt from collapsing inwardly when the pressure in cavity 106 is reduced.

Figure 3:
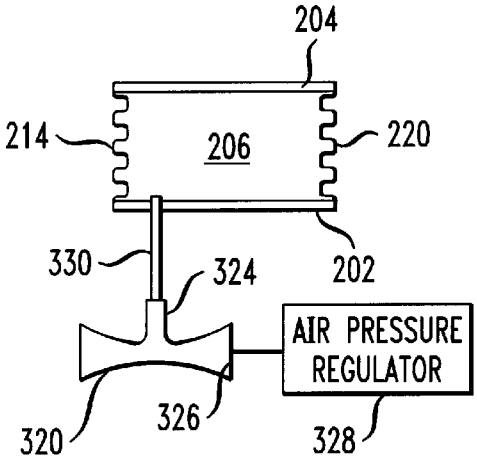
FIG. 3 depicts an illustrative embodiment of a vacuum system for collapsing/expanding the cavity of the z-axis positioning stage of FIG. 2.

In the embodiment illustrated in FIG. 2, collapse/expansion of cavity 206 is effected using vacuum system 208, an illustrative embodiment of which is depicted in more detail in FIG. 3. In the embodiment depicted in FIG. 3, vacuum system 208 is implemented as air ejector 320 and air pressure regulator 328. Conduit 330 places cavity 206 in fluid communication with vapor inlet port 324 of ejector 320, thereby operatively connecting the cavity and the ejector. For the purposes of this Specification, two regions are described to be in "fluid communication," when flow and/or pressure conditions prevailing in one of the regions affects fluid flow and/or pressure conditions in the other of the regions.

Air pressure regulator 328 regulates the flow of air into motive-fluid (e.g., air) inlet 326 of ejector 320. The flow of air through ejector 320 generates a suction at vapor inlet port 324. That suction draws vapor from cavity 206, thereby reducing the pressure therein. Cavity 206 partially collapses due to such a reduction in pressure. The partial vacuum generated within cavity 206 is a function of the air flow through ejector 320, which, as noted above, is controlled by air pressure regulator 328.

A control system is advantageously used in conjunction with the present Z-axis positioner. Such a control system allows an operator to simply specify a desired position for receiving platform 204, rather than having to manually adjust the operation of the vacuum system (e.g., adjust the pressure of air pressure regulator 328) via trial and error to move the receiving platform to a desired location. An illustrative control system suitable for use in conjunction with the present invention is depicted in FIG. 4.

Figure 4:
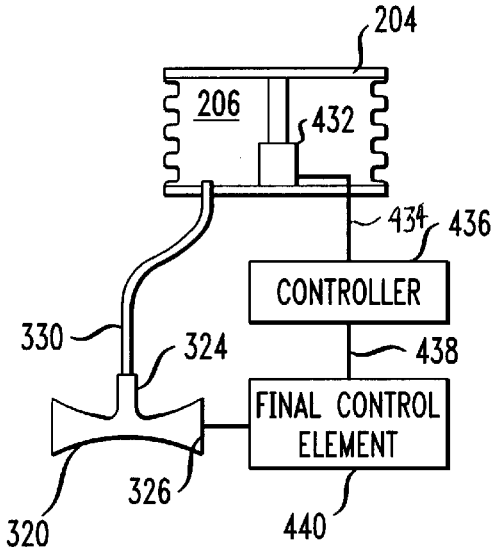
FIG. 4 depicts an illustrative control mechanism for use in conjunction with the positioner of FIG. 2.

The illustrative control system depicted in FIG. 4 includes displacement sensor 432, controller 436, and final control element 440, interrelated as shown. Displacement sensor 432 is operable to sense the displacement of receiving platform 204 (from a "zero" position), and is further operable to generate a first signal indicative of such displacement. The first signal is transmitted, over line 434, to controller 436. Controller 436 compares the first signal with a set-point signal indicative of a desired position of receiving platform 204. A difference between the actual and desired locations is determined. Based on that difference, a control signal is transmitted from controller 436 over line 438 to final control element 440. That control signal causes a change in final control element 440 which ultimately causes a change in the position of receiving platform 204. In illustrative vacuum system 208 depicted in FIG. 3, final control element 440 is air pressure regulator 328.

Displacement sensor 432 can be a linear variable differential transformer or any one of a variety of other suitable devices known to those skilled in the art. Controller 436 is advantageously a PID controller, although other types of controllers (e.g., proportional, or proportional-integral) may suitably be used. Final control element 440 can be any device that is operable to cause a change in the measured parameter (e.g., displacement).

By way of illustration of the operation of the control system, if controller 436 determines that receiving platform 204 is further along the z-direction than desired (i. e., too high), the controller transmits a control signal that increases the desired output pressure of air pressure regulator 328. In turn, air flow through ejector 320 increases, which increases suction at vapor inlet port 324. That increase in suction increases the vapor flow out of cavity 206, thereby increasing the partial vacuum therein and dropping receiving platform 204.

In the embodiment depicted in FIG. 4, displacement sensor 432 is disposed within cavity 206. It should be understood that in other embodiments, the displacement sensor can be suitably located outside the cavity, depending upon the specifics of the displacement sensor. Moreover, while a "feedback" control arrangement is depicted in FIG. 4, "feedforward" control arrangements can also be used. Indeed, many different embodiments of control loops that use different elements and arrangements can be devised by those skilled in the art for use in conjunction with the present invention.

Figure 5A:
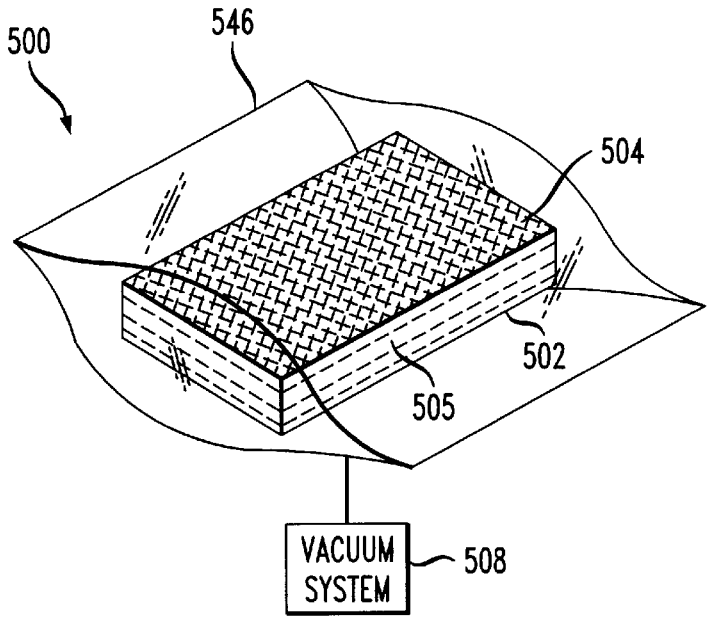
FIG. 5*a* depicts a multi-cavity z-axis positioning stage in accordance with the present teachings in an expanded (or uncollapsed) state.
Figure 5B:
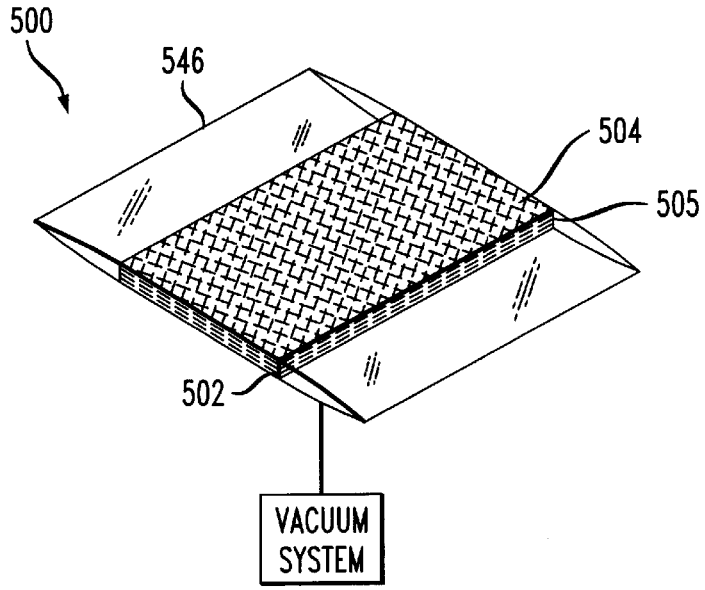
FIG. 5*b* depicts the multi-cavity z-axis positioning stage of FIG. 5*a* in a collapsed (or unexpanded) state.

FIGS. 5*a* and 5*b* depict illustrative Z-axis positioning stage 500 in accordance with the present teachings. Unlike Z-axis positioning stage 200 that has a single cavity 206, the region 505 between lower surface 502 and upper surface 504 of positioning stage 500 comprises a plurality of collapsible cells or cavities (not shown).

In one embodiment, region 505 comprises a porous material, such as porous plastic, porous rubber, porous cellulose or open-cell foams. One illustrative implementation of region 505 is a sponge. For the purpose of improving the stability of plural-cavity positioning stage 500 in the X-Y plane, a first rigid plate is advantageously disposed beneath lower surface 502 and a second rigid plate is advantageously disposed on upper surface 504.

Illustrative Z-axis positioning stage 500 further includes means for collapsing/expanding plural cavities 506. In the embodiment depicted in FIG. 5, such means include a pressure-tight collapsible enclosure 546 and vacuum system 508 operable to change pressure within the enclosure. Enclosure 546 encloses upper and lower surfaces 502, 504, region 505 therebetween comprising plural cavities 506, and the optional rigid plates. In other embodiments, an optional third rigid plate is disposed outside of enclosure 546 over the second rigid plate.

Enclosure 546 is used when the perimeter of region 505 is not pressure tight such that cavities 506 would otherwise be in contact with the ambient environment. For example, enclosure 546 is required when region 505 is implemented as a sponge. In other embodiments in which region 505 has a solid, pressure-tight perimeter, enclosure 546 is not required.

The various cavities are advantageously in pressure equilibrium with one another. This is readily achieved when region 505 comprises an open-celled material. If the cavities are not in fluid communication with one another, then each such cavity is advantageously placed in fluid communication with a common pressure/vacuum source.

Like Z-axis positioning stage 200, when a partial vacuum is developed that collapses cavities 506, region 505 collapses such that upper surface 504 drops toward lower surface 502.

It should be appreciated that if a plural cavity Z-axis positioning stage is implemented using a sponge, then the stage should be used to position objects that are substantially smaller than upper surface 504, and relatively light. Moreover, if a sponge is used, the "infinite" positioning resolution of a single cavity embodiment is sacrificed. The sponge is more reliability used as a two-position device; either fully compressed or fully uncompressed. As an alternative to fully compressing the sponge, rigid "stops" are advantageously embedded in the sponge. A rigid plate disposed on upper surface 504 of the sponge will "bottom out" against such stops preventing full compression of the sponge. Any instability in the sponge that may be experienced under full compression is therefore avoided.

The present Z-axis positioning stage can be used in conjunction with X-, Y- or XY-stages to provide a two- or three-axis positioning stage. An illustrative embodiment of a two-axis positioning stage 600 in accordance with the present teachings is depicted in FIG. 6.

Figure 6:
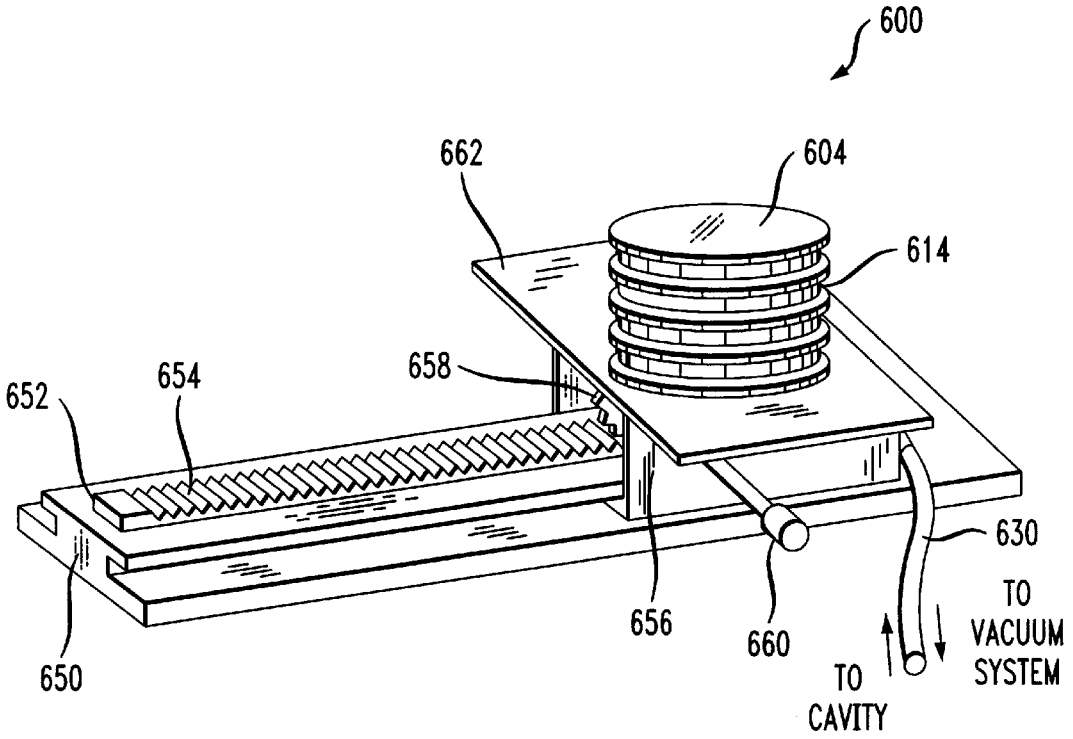
FIG. 6 depicts an illustrative multi-axes positioning stage in accordance with the present teachings.

As depicted in FIG. 6, positioning stage 600 is an X-Z positioning stage. In illustrative positioning stage 600, horizontal (X-axis) positioning is performed via a rack and pinion drive system. Horizontal-positioning elements comprise track 650, rack 652, platform 656, cogwheel 658 and knob 660, interrelated as shown. Cogwheel 658 and interconnected knob 660 are rotatably supported by platform 656. Cogwheel 658 is engaged to teeth 654 of rack 652. As knob 660 is turned, cogwheel 658 is drawn along rack 652 such that platform 656 moves horizontally along track 650.

Vertical (Z-axis) positioning of positioning stage 600 is performed via an embodiment of the present Z-axis positioner that is disposed on upper surface 662 of platform 656. The vertical positioning elements that are depicted in FIG. 6 include movable surface 604 and skirt 614 that define the collapsible/expandable cavity. Conduit 630 connects the cavity to a vacuum system (not shown) to effect movement of movable surface 604.

It is to be understood that the embodiments described in this specification are merely illustrative of the invention and that many variations may be devised by those skilled in the art without departing from the scope and spirit of the invention. It is therefore intended that such variations be included within the scope of the following claims and their equivalents.

We claim:

1. A multi-axis positioning stage comprising: a first positioning element operable to move an object alone a vertical axis, said first positioning element comprising:

a lower surface and a movable upper surface;

a side wall depending from said lower and upper surface;

at least one collapsible cavity defined within a region bounded by said lower and upper surfaces and said sidewall; and a device for collapsing the collapsible cavity; a second positioning element operably engaged to said first positioning element such that said second positioning element is operable to move said first positioning element along at least one horizontal axis, wherein movement alone said one horizontal axis changes a position of said first positioning element relative to said second positioning element.

2. The multi-axis positioning stage of claim 1, wherein the sidewall comprises pleats.

3. The multi-axis positioning stage of claim 2, wherein the side wall is rigid in a plane that is orthogonal to a direction of motion of the movable upper surface.

4. The multi-axis positioning stage of claim 3, wherein the side wall comprises metal.

5. The multi-axis positioning stage of claim 1, wherein the device for collapsing the collapsible cavity is operable to change pressure within the collapsible cavity.

6. The multi-axis positioning stage of claim 5, wherein the device for collapsing the collapsible cavity comprises a vacuum generator.

7. The multi-axis positioning stage of claim 6, wherein the vacuum generator comprises:

an injector; and a pressure regulator.

8. The multi-axis positioning stage of claim 1, and further comprising a feedback system operable to control the position of the upper surface in association with the device for collapsing the collapsible cavity.

9. The multi-axis positioning stage of claim 8, wherein the feedback system comprises:

a displacement sensor that senses a change in position of the upper surface;

a controller that receives a first signal from the displacement sensor that is indicative of the position of the upper surface and that further compares said first signal to a second signal indicative of a desired position of the upper surface, the controller further operable to adjust the operation of the device for collapsing the collapsible cavity as a function of the difference between the first and second signals.

10. The multi-axis positioning stage of claim 1, wherein plural collapsible cavities are defined within the region.

11. The multi-axis positioning stage of claim 10, wherein the region comprises a material selected from the group consisting of porous plastic, porous rubber, porous cellulose and open-celled foam.

12. The multi-axis positioning stage of claim 10, and further comprising:

a first plate disposed underneath the lower surface and a second plate disposed on top of the upper surface.

13. The multi-axis positioning stage of claim 12, wherein the device operable to collapse the collapsible cavities comprises:

a pressure-tight collapsible enclosure that encloses the upper and lower surfaces and the collapsible cavities; and a vacuum generator operable to change pressure within the pressure-tight collapsible enclosure.

14. The multi-axis positioning stage of claim 11, further comprising a stop for preventing full collapse of the region.

15. The multi-axis positioning stage of claim 1, further comprising:

a positioning device operable to move an object along at least one horizontally-disposed axis, said positioning device engaged to one of said lower or movable upper surfaces.

16. The multi-axis positioning stage of claim 1, wherein the second positioning element comprises:

a cog rotatably supported from a platform; and a rack having teeth operatively engaged to the cog, wherein, said lower surface of said first positioning element is disposed on an upper surface of the platform.

* * * * *